US006568109B2

(12) United States Patent
Sanders

(10) Patent No.: US 6,568,109 B2
(45) Date of Patent: May 27, 2003

(54) CHANGEABLE ADDRESS DISPLAY

(76) Inventor: Eddie Sanders, 8236 S. Dante St., Chicago, IL (US) 60619

( * ) Notice: Subject to any disclaimer, the term of this patent is extended or adjusted under 35 U.S.C. 154(b) by 0 days.

(21) Appl. No.: 09/817,697

(22) Filed: Mar. 26, 2001

(65) Prior Publication Data

US 2002/0020090 A1 Feb. 21, 2002

Related U.S. Application Data

(63) Continuation-in-part of application No. 09/248,045, filed on Feb. 10, 1999, now abandoned.

(51) Int. Cl.[7] ..... G09F 13/04
(52) U.S. Cl. ..... 40/447; 40/564; 40/465
(58) Field of Search ..... 40/447, 452, 463, 40/465, 564; 361/173; 250/214 B, 214 C, 221, 222.1

(56) References Cited

U.S. PATENT DOCUMENTS

| | | | | | |
|---|---|---|---|---|---|
| 4,009,535 | A | | 3/1977 | Stock | 40/130 K |
| 4,162,036 | A | * | 7/1979 | Balduzzi et al. | 236/47 |
| 4,254,457 | A | | 3/1981 | Lordier | 362/367 |
| 4,343,032 | A | * | 8/1982 | Schwartz | 362/276 |
| 4,373,284 | A | | 2/1983 | Crane | 40/576 |
| 4,385,841 | A | * | 5/1983 | Kramer | 368/29 |
| 4,587,753 | A | | 5/1986 | Harper | 40/451 |
| 4,611,265 | A | | 9/1986 | Davis | 362/145 |
| 4,686,505 | A | | 8/1987 | Vanderburg | 340/331 |
| 4,901,461 | A | | 2/1990 | Edwards et al. | 40/575 |
| 4,937,499 | A | | 6/1990 | Hunte | 315/149 |
| 4,994,941 | A | * | 2/1991 | Wen | 362/26 |
| 5,007,190 | A | | 4/1991 | Shyu | 40/564 |
| 5,473,337 | A | * | 12/1995 | Berger | 345/34 |
| 5,521,578 | A | | 5/1996 | DelValle | 340/330 |
| 5,522,540 | A | | 6/1996 | Surman | 232/17 |
| 5,556,686 | A | | 9/1996 | O'Shea | 428/99 |
| 5,649,378 | A | | 7/1997 | Roesser, Jr. et al. | 40/559 |
| 5,796,347 | A | * | 8/1998 | Zulaski | 361/173 |
| 5,883,605 | A | * | 3/1999 | Knapp | 345/7 |
| 5,903,107 | A | * | 5/1999 | Wade | 315/129 |
| 6,060,838 | A | * | 5/2000 | Cantoni et al. | 361/174 |
| 6,317,043 | B1 | * | 11/2001 | Berk | 340/555 |

* cited by examiner

*Primary Examiner*—Cassandra Davis
(74) *Attorney, Agent, or Firm*—Clifford Kraft

(57) ABSTRACT

An improved address display device that can automatically adjust its light output intensity to ambient light conditions and is readily changeable to any address. The device can be remotely turned on by either a bright light or radio signal from an emergency vehicle. An LED 7-segment display with numerals and letters, 7-segment lamp tubes, a dot-matrix LED, electric bulbs or tubes, or any other display means produces a display visible and readable to a person with normal vision at a distance of exceeding 50 feet and preferably over 100 feet both day and night. A photocell or other ambient light sensing device automatically adjusts intensity for various ambient conditions such as bright sunlight, night, fog, or other conditions. The device contains a circuit that allows immediate adjustment or change of the address. There are at least two embodiments of this feature: 1) the ability to set each digit with switches, and 2) a counter circuit that causes the address to count when a button is depressed. The second embodiment can contain a slow/fast switch to control the counting speed.

6 Claims, 5 Drawing Sheets

CHANGEABLE ADDRESS DISPLAY

This is a Continuation-In-Part of application 09/248,045 filed Feb. 10, 1999, now abandoned.

BACKGROUND

1. Field of the Invention

This invention relates generally to the field of address display devices and more particularly to an address numbering system that is adaptable to any address.

2. Description of Related Art

Addresses appear on the side of buildings and houses, over garages, on curbs, and on mailboxes. However, many times it is very difficult for police or emergency vehicles to find a house, building, or apartment address because there is no adequate indication of the address that is visible, especially at night.

Prior art address display devices have all been directed to a certain fixed home address because they all contain fixed carved or cut-out numbers. Many prior art devices are lighted and even contain flashers. Some are solar powered, and some are powered from house power. An example of these prior art devices is contained in U.S. Pat. No. 4,587,753 issued to Harper. Harper teaches a frame for holding stylized numbers that are lighted from behind with lamps that can flash or remain on continuously. To change the address, a new stamped sheet must be produced.

Most prior art devices are lighted by lamps; however U.S. Pat. No. 5,007,190 issued to Shyu teaches the use of light emitting diode (LED) displays. However, Shyu places the LED's behind a fixed cut-out with the address number. Thus, it is very difficult to change the address with Shyu's device. It is necessary to open the housing and place another carved address plate to change the address.

U.S. Pat. No. 5,522,540 issued to Surman teaches a solar powered device that can attach to the side of a house or to a mailbox. Again, the numbers are cut out of a fixed panel.

What is badly needed is an address display device that can be seen day or night and can be easily changed to any address. The device can automatically adjust its brightness for ambient daylight or night conditions (or other ambient conditions such as fog). Such a device would be usable for emergencies or to display the home, apartment, or business address from a window or outdoors. Also what is needed is a way that police, firemen, or other emergency personnel can activate the address device if it is turned off.

SUMMARY OF THE INVENTION

The present invention relates to an improved address display device that can automatically adjust its light output intensity to ambient light conditions and that is readily changeable to any address. In general, it can change between a preset or predetermined dim level and a preset or predetermined bright level; however, the change can be continuous as well. It can be activated remotely by emergency personnel.

The present invention can use LED segment display numerals and letters, segment lamp tubes, a dot-matrix LED, electric bulbs or tubes, or any other display means to produce a display visible and readable to a person with normal vision at a distance exceeding 50 feet and preferably over 100 feet, both day and night.

The present invention can contain a photocell or other ambient light sensing device to automatically adjust intensity for various ambient conditions such as bright sunlight, night, fog, or other conditions. This photodetector can be recessed in a light tunnel to avoid changing brightness in the presence of glare, especially that caused by headlights. This is critical so that the display will not dim when an emergency vehicle turns into a driveway and glare from the headlights reaches the display. The photodetector can be optionally used to turn on the display by the beam of a headlight, a flashlight, a spotlight, or any other bright light.

The present invention can contain a circuit that allows immediate adjustment or change of the address. There are at least two embodiments of this feature: 1) the ability to set each digit with switches, and 2) a counter circuit that causes the address to count (like many clock setting circuits known in the art) when a certain button is depressed. The second embodiment can contain a slow/fast switch to control the counting speed. Any other means of setting or changing the address is also within the scope of the present invention.

The present invention can optionally contain a feature where it can be turned on remotely. It is not always desirable for the display to be on continuously. The present invention can be optionally turned on by either a bright light or by a radio signal. In one embodiment, the display can be turned on in the presence of a very bright light such as the spotlight from a police car or other emergency vehicle, a bright flashlight such as those used by the police, or by the headlights of a vehicle. Another embodiment of the invention can turn on the display on command by a radio signal from the emergency vehicle in a manner similar to a garage door opener. The preferred method is to turn on the display in the presence of a bright light, because this method is simpler and does not require any special radio equipment.

Either of these embodiments where the display is turned on by an emergency vehicle can be equipped with a timer that turns the display off again after a predetermined time delay. A preferred time delay would be around 5 minutes; however, this could be adjustable by the user, and any reasonable time delay would be within the scope of the invention.

The various embodiments of the present invention can be enhanced by mirrors, lenses or other devices known to increase visibility, or by causing the display to blink; however, these features are optional, and the present invention can totally function without them.

DETAILED DESCRIPTION

Figure 1:
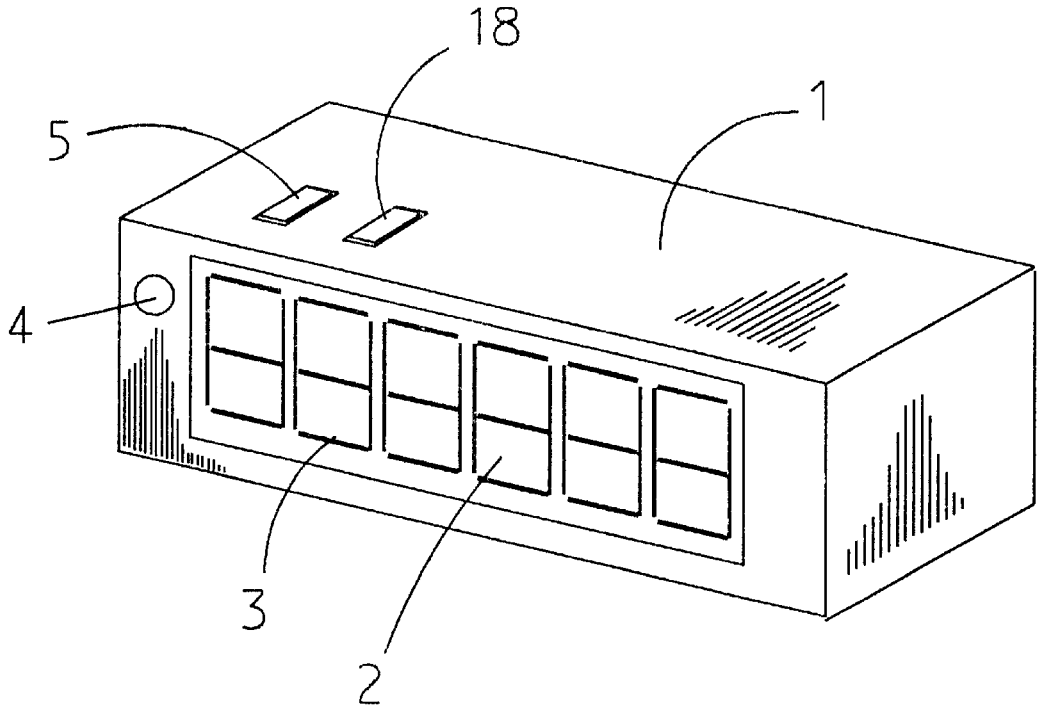
FIG. 1 shows a perspective view of a possible embodiment of the present invention.

Turning to FIG. 1 a possible embodiment of the present invention can be seen. Here a housing or container 1 holds a rack of display lights 3 mounted in a frame 2. The box or container 1 can be metal, wood, plastic, or any other material capable of enclosing an electronic circuit. The display lights 3 can be LED's, including 7-segment displays known in the art, segment display tubes, dot matrix displays, electric bulbs or tubes, or any other type of light display capable of displaying a numeral or letter; 7-segment or dot matrix displays are preferred.

While FIG. 1 shows six such display lights, there can be any number of them necessary to display any address on any building in the world. The display devices 3 can also display a number in arabic numerals, roman numerals, or numbers from any numbering system worldwide. The display devices 3 can display any letter from any western alphabet including letters with accents or umlauts. The scope of the light display 3 of the present invention is to display any possible address. The color of the display lights 3 can be red, white, yellow, or any other color. Red or yellow is the preferred color since there are many commercially available red displays and since yellow is the most visible color to the human eye.

The frame 2 can be any type of frame suitable for holding the display devices 3 discussed above. A first switch 5 allows changing of the address displayed by the display devices 3. While only one such address switch 5 is shown in FIG. 1, there may be any number of switches on different embodiments of the present invention sufficient to change or select any address in the world from any alphabet. In addition, there can be a second switch 18 to select slow or fast counting of a numeric or letter display. The preferred method is to have two switches, one for fast/slow counting selection and the other for counting to change the displayed address.

An optional photo sensor 4 can detect the amount of ambient light and set the brightness of the display lights 3 so that the displayed address can be seen at distances from 50 to over 100 feet day or night. The preferred type of photo-sensor is one that detects visible light in the range normally encountered between dark and noon daylight on a typical sunny day; however, any type of photo-sensor will work. In addition, an optional second switch 18 can allow manual changing of the display from bright to dim or off. The photodetector or photosensor 4 is preferred to be of the type which increases current with increasing exposed light; however, it can be any type of photodetector or sensor that now exists or that may be invented in the future to sense ambient light.

Figure 2:
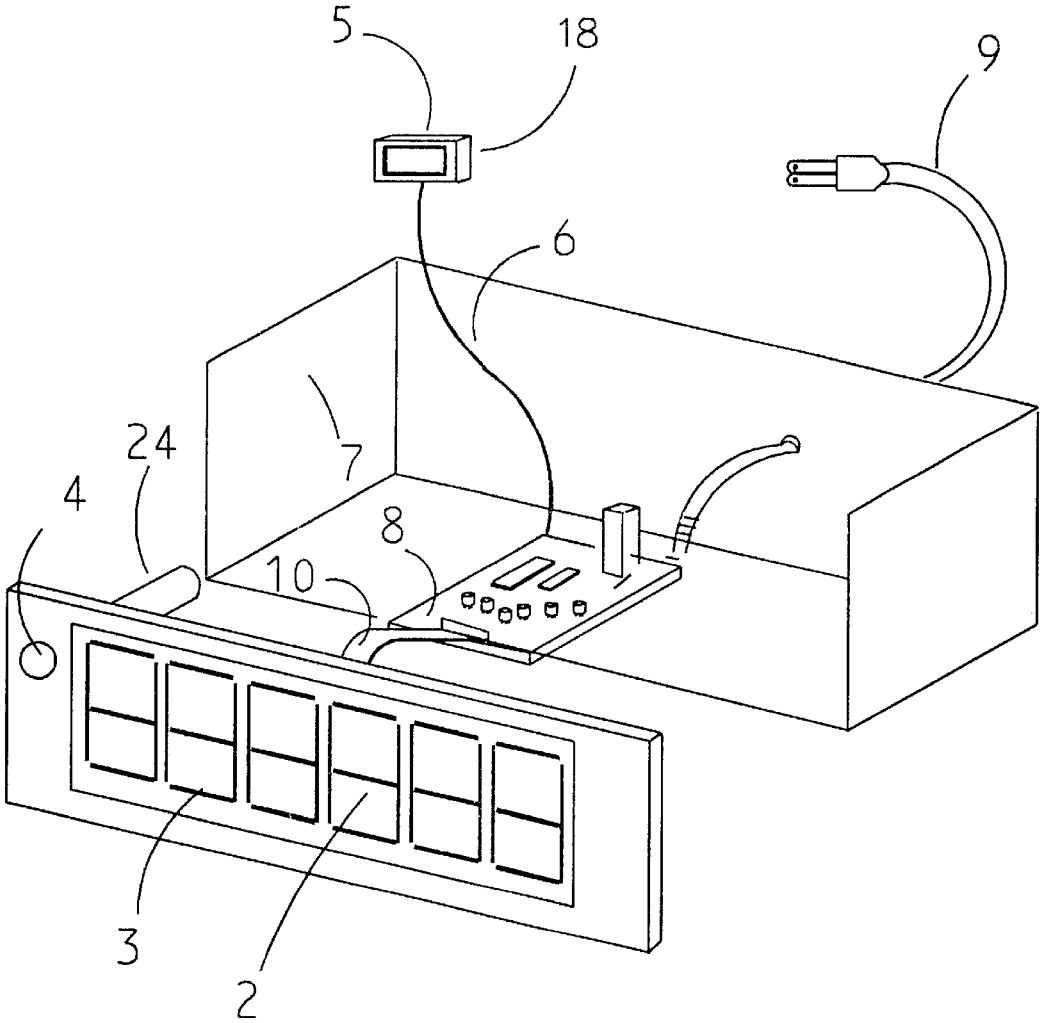
FIG. 2 shows a breakout view of the embodiment of FIG. 1.

FIG. 2 shows an exploded view of the embodiment from FIG. 1. Here again the frame 2 and display devices 3 can be seen as before. In addition the inside of the box or container 7 can be seen as well as an electronic circuit board 8. While one circuit board 8 is shown in FIG. 2, any number of circuit boards can be installed in the present invention; one is the preferred number.

The circuit board 8 can contain a power supply, preferably running from 120 volt house current, counters, decoders and light drivers to supply power to the display devices 3 over one or more cables 10. The circuit board 8 can optionally contain a circuit that senses the value of a photodetector 4 and adjusts the brightness of the display lights 3 to compensate for ambient light. The preferred compensation is to make the display lights brighter in daytime or larger amounts of ambient light to maintain visibility and to make it dimmer at night so that it doesn't glare. The photodetector 4 can be recessed in an optional light tunnel 24 that accepts mostly only light coming straight in rather than light from any angle. This feature mostly eliminates any response from headlight glare. Another way of decreasing the sensitivity to headlight glare is to mount the photodetector 4 on the side or top of the housing 1.

A power cord 9 can be also be seen in FIG. 2. This cord can deliver power from a standard 110 or 220 volt building system to the present invention. It should be noted that the present invention can be run from any power supply including a 12 volt battery or other supply besides commercial power; however, the preferred method is to operate the present invention from commercial building power.

Figure 3:
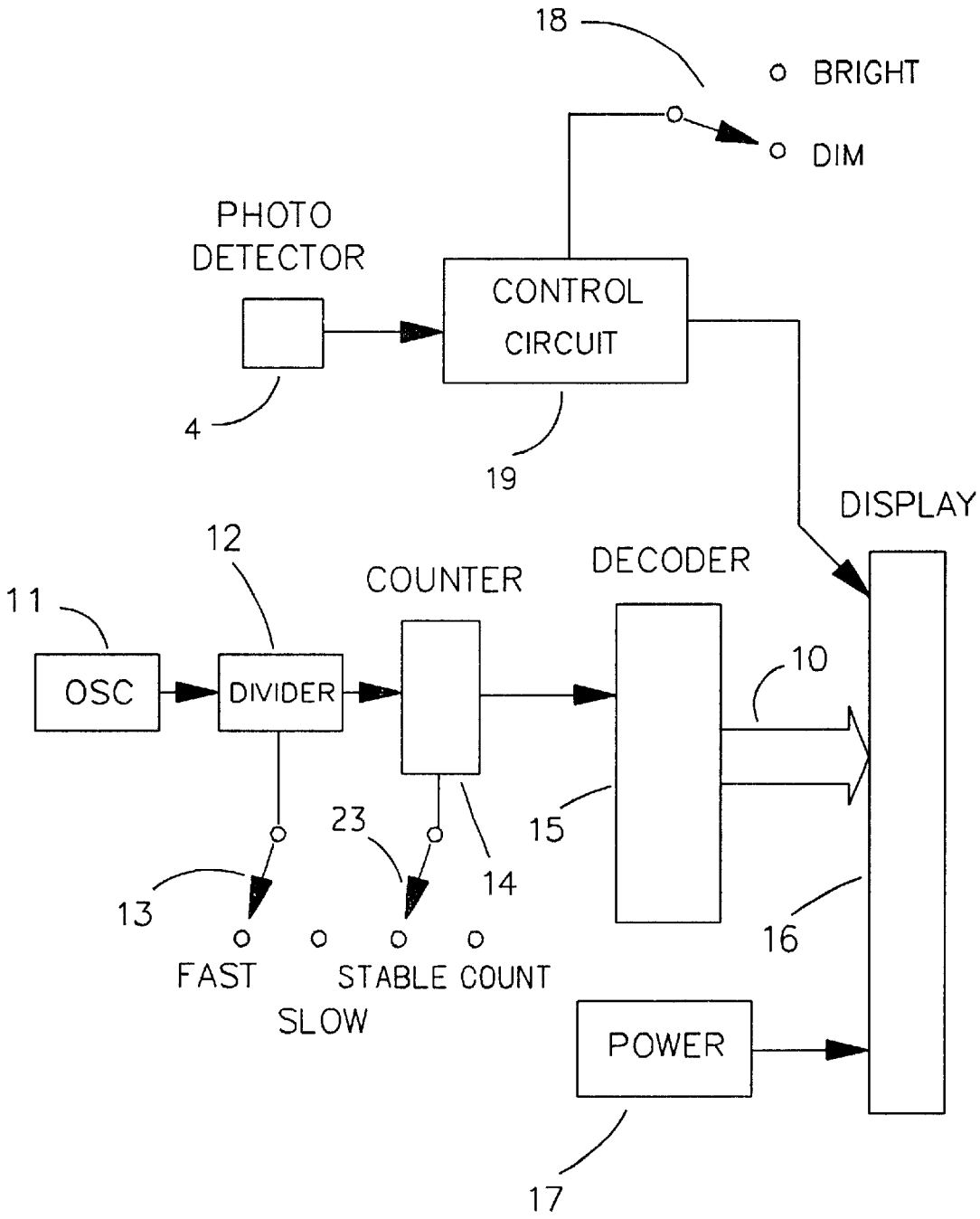
FIG. 3 shows a block diagram of a possible embodiment of the present invention.

FIG. 3 shows a block diagram of a possible method of causing the display 16 (which are the display lights from the previous figures) to change the displayed address. An oscillator 11 supplies a sine or squarewave (or any other repetitive wave shape) into a digital divider 12 known in the art. The divide ratio can optionally be changed by a switch 13 to achieve a fast or slow count. The count can be stopped by an optional switch 23 to achieve a stable address. The divider 12 drives a counter 14 which can be a conventional digital counter. The preferred method is to use a counter 14 which delivers a binary coded output to a decoder circuit 15. The counter 14 can be a binary or decimal counter, or any other type of counter. The counter can count up, down, or both up and down. The preferred counter is binary with enough bits to cover the largest numeric address. If alphanumeric (letters) characters are also used, the counter must contain enough bits to represent the largest numeric plus alphanumeric address desired.

The binary, or otherwise coded, word from the output of the counter 14 is decoded by a decoder circuit 15 to a form suitable to directly drive the display 16 (display lights 3 in FIGS. 1 and 2). The decoded display signal is delivered from the decoder (usually on a circuit board) to the display 16 by one or more cables 10. The preferred cable is a flat ribbon cable containing enough conductors for the number of connections on the display 16. The decoder may be on the circuit board 8 as shown in FIG. 3, or it may be contained in the display 16 itself. A power supply 17 supplies power of the correct voltage and current to drive the display 16. The voltage and character (AC or DC) of the supplied power will depend on the requirements of the display lights making up the display 16. Typically 7-segment display lights need 5–25 volts to drive them. Some types of display lights are supplied from manufacturers with decoders and even counters built into them. This type of display light is within the scope of the present invention. If this type of display light is used, the decoder 15 and/or counter 14 in FIG. 3 on a circuit board is unnecessary.

An optional photo-sensor 4 can drive a control circuit 19 to control the brightness of the display 16. Normally, the display should become brighter as the amount of ambient light increases in order that the address may be readable in bright light as well as dim conditions or at night. In addition, a second switch 18 can manually control bright and dim conditions of the display optionally overriding the action of a photo-sensor (if one is present). It is also possible to shut the lights off in daytime. In one embodiment of the present invention, only two possible brightness levels are used, a bright level for daytime, and a dim level for nighttime, or times of dim sunlight. In this embodiment, the photodetector 4 causes the brightness of the display devices 3 to change from bright to dim as the ambient light changes from day to night.

Figure 4:
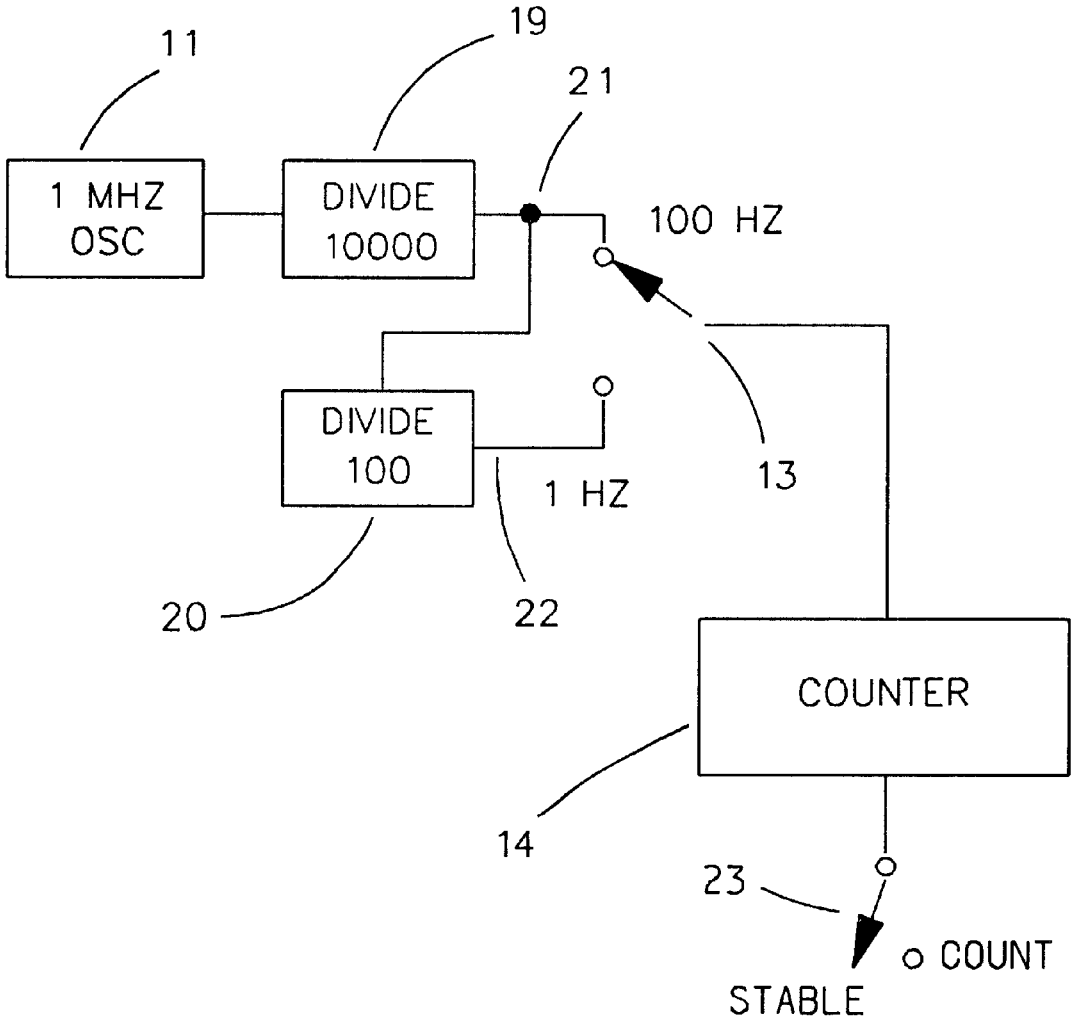
FIG. 4 shows a digital block diagram of a fast/slow count circuit.

Turning to FIG. 4, a block diagram of a digital fast/slow count circuit is shown. This circuit is set up so that in slow count, the lowest order digit counts about once per second while in fast count, the third digit counts about once per second. The ratio between fast and slow count should be chosen based on the number of digits present in the address. In general, the next to last digit should count about once or twice per second in fast count mode. However, this count speed and ratio is very arbitrary. Many other count speeds and ratios are within the scope of the present invention. It is also possible to change count speed based on how long the count button has been depressed. This latter method, while within the scope of the present invention, is not shown in FIG. 4.

In FIG. 4, a 1 MHz oscillator 11 is shown driving a set of decimal dividers 19 which divide the signal by a factor of 10,000. The output of these dividers 21 is 100 Hz. A fast/slow switch 13 can select the 100 Hz signal to drive the counter 14 directly (in the switch position shown in FIG. 4). Here the low order counter digit cycles through 10 counts at a rate of 100 times per second. This is the fast count mode. The third digit will count at 1 time per second and the fourth digit will count at one count per 10 seconds. The output of the divide by 10,000 divider 19 is also connected to another divider 20; this time a divide by 100 decimal divider. The output of this divider 22 is 1 Hz. With the switch 13 in the alternate position, the counter 14 is supplied with a 1 Hz count clock. This is the slow count position. In this case the low order digit counts at a rate of 1 count per second. An optional switch 23 can control whether the display is counting or displaying a stable address. It must be remembered that this is only one embodiment of a fast/slow count circuit. Many other types of dividers and divide ratios can be used.

Figure 5:
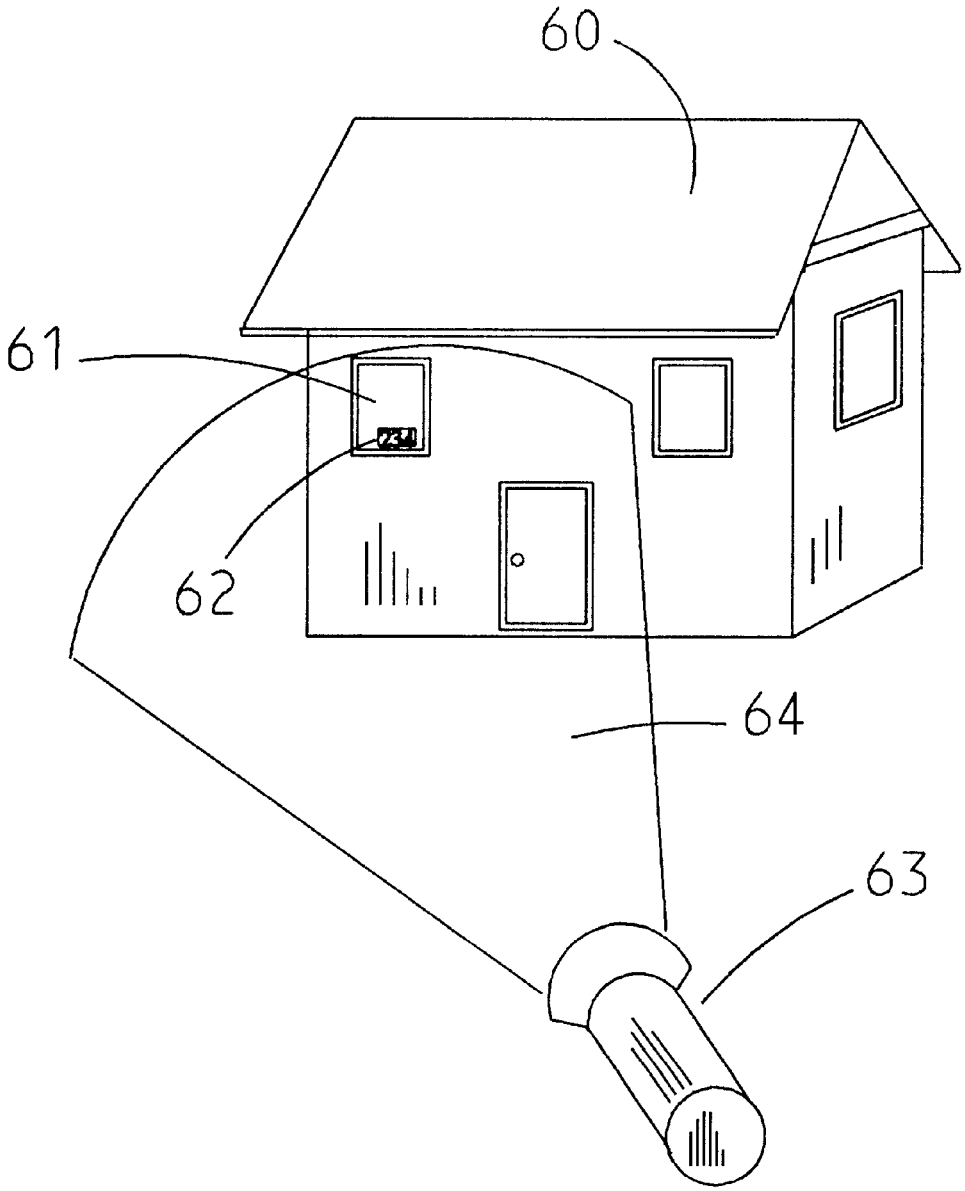
FIG. 5 shows a beam from a flashlight turning on the display in an emergency situation.

Turning to FIG. 5, an embodiment of the invention is seen where a bright light from an emergency vehicle turns on the display, usually for a predetermined time. A house or any other building 60 has a window 61 with this embodiment of the present invention 62 in the window. Here a flashlight 63 is shown putting a beam of light 64 into the window 61 and onto the display unit 62. The display unit senses this light with a photodetector (previously described) and causes the display to turn on either at a fixed brightness level, or at the correct brightness level for the amount of ambient light. The light that activates the display need not come from a flashlight, but rather can come from any source of bright light on the emergency vehicle, or any other vehicles, such as a spotlight or headlight, or any other source of bright light. The display can then either stay on, or can contain a timer that causes it to remain on for a predetermined time. This predetermined time could be adjustable or fixed. A preferred fixed time is around 5 minutes; however, any other reasonable fixed time is within the scope of the present invention.

While the preferred embodiments of the present invention have been shown and described, it is to be understood that various modifications and changes could be made thereto without departing from the scope of the appended claims. It is understood that means shown to accomplish the goals of the invention are for illustration only. Many other means are within the scope of the invention, including means that may be invented in the future to perform the functions specified.

I claim:

1. A remotely activated building address display device comprising:

a housing, and an AC power source;

a plurality of alphanumeric display devices contained in said housing, each of said display devices changeably capable of displaying a single digit of an address, said digit being a number or a letter, said display devices powered by said AC power source;

a control circuit in said housing capable of turning said display devices off and on, and capable of adjusting brightness of said display devices;

a counting circuit, said counting circuit allowing said alphnumeric display to be changed by counting through a predetermined sequence;

a light sensor mounted at the end of an elongated tube, whereby said tube prevents said light sensor from sensing headlight glare;

said light sensor causing said control circuit to turn on said alphanumeric display devices in the presence of bright emergency light, said control circuit also causing said display devices to increase in brightness in bright light and decrease in brightness in dim light;

a timer coupled to said control circuit, said timer causing said alphanumeric display device to stay on for a predetermined time after said light sensor detects the presence of said bright light.

2. The building address display device of claim 1 wherein said light sensor is a photocell.

3. The building address display device of claim 2 wherein said photocell outputs increasing current in increasing ambient light conditions.

4. A remotely activated building address display device comprising:

a housing means, and an AC power source;

an of alphanumeric LED display means contained in said housing means for displaying a single digit of an alphanumeric address, said digit being a number or a letter, said display means powered by said AC power source;

a control circuit in said housing capable of turning said display means off and on, and capable of adjusting brightness of said display devices;

a counting means for allowing said display means to be changed by counting through a predetermined sequence;

a light sensor means for sensing the presence of a external light mounted at the end of an elongated tube, said tube preventing said light sensor means from sensing headlight glare;

said light sensor means causing said control circuit to turn on said alphanumeric LED display means in the presence of bright emergency light, said control circuit causing said alphanumeric display means to increase in brightness in bright light and decrease in brightness in dim light;

a timer coupled to said control circuit, said timer causing said alphanumeric display means to stay on for a predetermined time after said light sensor means detects the presence of bright light.

5. The remotely activated building address display device of claim 4 wherein said sensor means is a photocell.

6. The remotely activated building address display device of claim 4 wherein said display means contains a plurality of LED devices.

* * * * *